US005463270A

United States Patent [19]

Wakimizu et al.

[11] Patent Number: 5,463,270

[45] Date of Patent: Oct. 31, 1995

[54] INSULATING BASE FOR DISCHARGE LAMP DEVICE

[75] Inventors: Yukio Wakimizu; Kunimasa Motiduki; Masakazu Nagasawa, all of Shizuoka, Japan

[73] Assignee: Koito Manufacturing Co., Ltd., Tokyo, Japan

[21] Appl. No.: 195,442

[22] Filed: Feb. 14, 1994

[30] Foreign Application Priority Data

Feb. 16, 1993 [JP] Japan ..... 5-026814

[51] Int. Cl.[6] ..... H01J 5/48

[52] U.S. Cl. ..... 313/318.01; 313/318.03; 313/318.05; 313/318.08; 313/318.09; 439/611

[58] Field of Search ..... 313/318, 318.01, 313/318.02, 318.03, 318.04, 318.05, 318.06, 318.07, 318.08, 318.09, 318.1, 318.11; 439/611, 616, 617, 619

[56] References Cited

U.S. PATENT DOCUMENTS

| | | | |
|---|---|---|---|
| 5,059,855 | 10/1991 | Irisawa et al. . | |
| 5,126,619 | 6/1992 | Wakimizu et al. . | |
| 5,270,610 | 12/1993 | Schoenherr et al. | 313/318 |
| 5,291,092 | 3/1994 | Coushaine | 313/318 |

FOREIGN PATENT DOCUMENTS

| | | |
|---|---|---|
| 2234628 | 2/1991 | European Pat. Off. . |
| 2661275 | 10/1991 | France . |
| 4079146 | 3/1992 | Japan . |

*Primary Examiner*—Donald J. Yusko
*Assistant Examiner*—N. D. Patel
*Attorney, Agent, or Firm*—Sughrue, Mion, Zinn, Macpeak & Seas

[57] ABSTRACT

An insulating base for a discharge lamp device which provides good insulation between a lead support connected to a front end lead of an arc tube and a lead disposed on the rear side of the arc tube. The insulating base includes a base main body formed of synthetic resin. The base main body is a disk-shaped injection molding which includes a lead support insertion hole in the form of a first longitudinal through hole for mounting a lead support supporting the front end portion of an arc tube and acting as a current path to a lead disposed on the front side of the arc tube, and a lead insertion hole in the form of a second longitudinal through hole for insertion of a lead disposed on the rear end side of the arc tube. The base main body is molded in such a manner that a separation wall area between the lead support insertion hole formed in the front surface of the base main body and the lead insertion hole faces molten resin injection gates provided in base main body molding metal molds, thereby preventing a weld portion from being produced in the separation wall area between the two holes.

6 Claims, 5 Drawing Sheets

INSULATING BASE FOR DISCHARGE LAMP DEVICE

BACKGROUND OF THE INVENTION

The present invention relates to a discharge lamp device including an arc tube mounted on the front surface of an insulating base and, in particular, to an insulating base for a discharge lamp device which supports an arc tube.

In FIG. 7 is shown a conventional discharge lamp device in which a pair of lead supports 2 and 3, which conduct energizing current to an arc tube, project forwardly of an insulating base 1 formed of synthetic resin. An arc tube 4 is supported by the supports 2 and 3. A globe 5 enclosing the arc tube 4 to screen ultraviolet rays is fixed to and held by the front surface of the base 1, so that ultraviolet rays generated by the arc tube 4 and which are in a wavelength range harmful to health are cut off by the globe 5. Reference numeral 6 designates a ceramic disk fixed to the front surface of the base 1 by suitable means such as a screw, an adhesive or the like, with the opening end portion of the globe 5 being bonded to the disk 6. Reference numerals 9*a* and 9*b* indicate a pair of terminals provided on and projecting from the rear surface side of the base 1. The terminals 9*a* and 9*b* are welded integrally to the lead supports 2 and 3, respectively, and the lead supports 2 and 3 are connected through metal support members a and b to leads 4*a* and 4*b* which are electrically connected to respective ones of the opposing electrodes of the arc tube 4.

However, in the above-mentioned conventional discharge lamp device, since the arc tube 4 is supported by the two lead supports 2 and 3, the resulting structure of the discharge lamp device is unavoidably complicated. Also, the globe 5 for screening of ultraviolet rays must be of a size sufficient to enclose the arc tube 4 and the two lead supports 2 and 3, which causes the discharge lamp device to be large in size.

To solve the above problems and to simplify the structure of the lamp device and thus realize a compact lamp device, there has been proposed a discharge lamp device, as disclosed in Japanese Patent Application No. Hei. 4-54709, in which the rear end portion of an arc tube 4 is engaged with and supported by a recessed portion 1*a* formed in the front surface of a base 1 to thereby reduce the number of lead supports used from two to one. In FIG. 8, reference numeral 7 designates a glass disk welded to the opening end of a globe 5, and 8, staking members used to fix the disk 7. Reference numeral 1*b* designates a lead support insertion hole, and 9*a*, a lead which is a terminal electrically connected to a lead support 2. The conductors of power supply cords $L_1$ and $L_2$ are connected to the terminals 9*a* and 9*b*, respectively. FIG. 9 is an enlarged perspective view of the base 1 of the discharge lamp device shown in FIG. 8, while FIG. 11 is a longitudinal sectional view of the base 1.

However, to mold a base 1 shown in FIG. 9, as shown by wide arrows in FIG. 10, molten resin is supplied into the cavity of a metal mold from six positions corresponding to the outer peripheral edge portions of the base; that is, the cavity of the metal mold for injection molding has a structure wherein gates serving as molten resin injection holes are positioned in the outer peripheral edge portion of the base to be molded. For this reason, in the outer peripheral edge portion of the conventional base 1, there are left gate traces, as indicated by P in FIG. 9, which makes the base 1 look less attractive. It is possible to remove the gate traces P by cutting or the like in a step subsequent to molding, but this, however, increases the number of steps and thus increases the cost of the base 1.

Also, the molten resin supplied into the cavity from the gates can flow smoothly into a large space area as shown by A in FIG. 10 because the flow resistance is small, but it is difficult for the molten resin to flow into a narrow space area indicated by B in FIG. 10 because the flow resistance is large. A weld can easily be generated in the latter case.

The arrows in FIG. 10 show the directions in which the molten resin supplied into the cavity from the gates flows; that is, the molten resin is first filled in the wide area indicated by A, and is finally filled in a separation wall (a narrow area indicated by B) interposed between the lead support insertion hole 1*a* and lead insertion hole 1*b*. Due to this, a weld W (see FIGS. 8 and 11) is generated in the separation wall between the two insertion holes 1*a* and 1*b*. The weld W degrades the insulation between the lead support 2 and lead 4*b*.

SUMMARY OF THE INVENTION

It is an object of the present invention to eliminate the drawbacks found in the above-mentioned conventional insulating base for a discharge lamp device, and to provide an insulating base for a discharge lamp device which can provide a high degree of insulation between a lead support connected to a lead disposed on the front side of an arc tube and a lead disposed on the rear side of the arc tube.

In attaining the above and other objects, according to the invention there is provided an insulating base for a discharge lamp device comprising a base main body of synthetic resin in the form of a disk-shaped injection molding which includes a lead support insertion hole, that is, a first longitudinal through hole for mounting a lead support for supporting the front end portion of an arc tube and acting as a path for a lead disposed on the front end side of the arc tube, and also includes a lead insertion hole serving as a second longitudinal through hole for insertion of a lead disposed on the rear end side of the arc tube, characterized in that the base main body is molded in such a manner that an area between the lead support insertion hole formed on the front surface of the base main body and the lead insertion hole is situated so as to face molten resin injection gates respectively formed in upper and lower metal molds for molding the base main body.

The molten resin supplied from the gates into the cavity flows from the separation wall forming area between the lead support insertion hole and the lead insertion hole on the rear side of the arc tube into the other portions, so that no weld is produced in the separation wall between the lead insertion hole on the rear side of the arc tube and the lead support insertion hole. Also, the portion where the weld is produced is on the opposite side of the lead insertion hole from the lead support, and the path through the weld portion is long, so that the insulation durability of the insulating base is not degraded due to the weld.

DESCRIPTION OF THE PREFERRED EMBODIMENTS

A description will now be given of preferred embodiments of an insulating base for a discharge lamp device constructed according to the invention with reference to the accompanying drawings.

Figure 1:
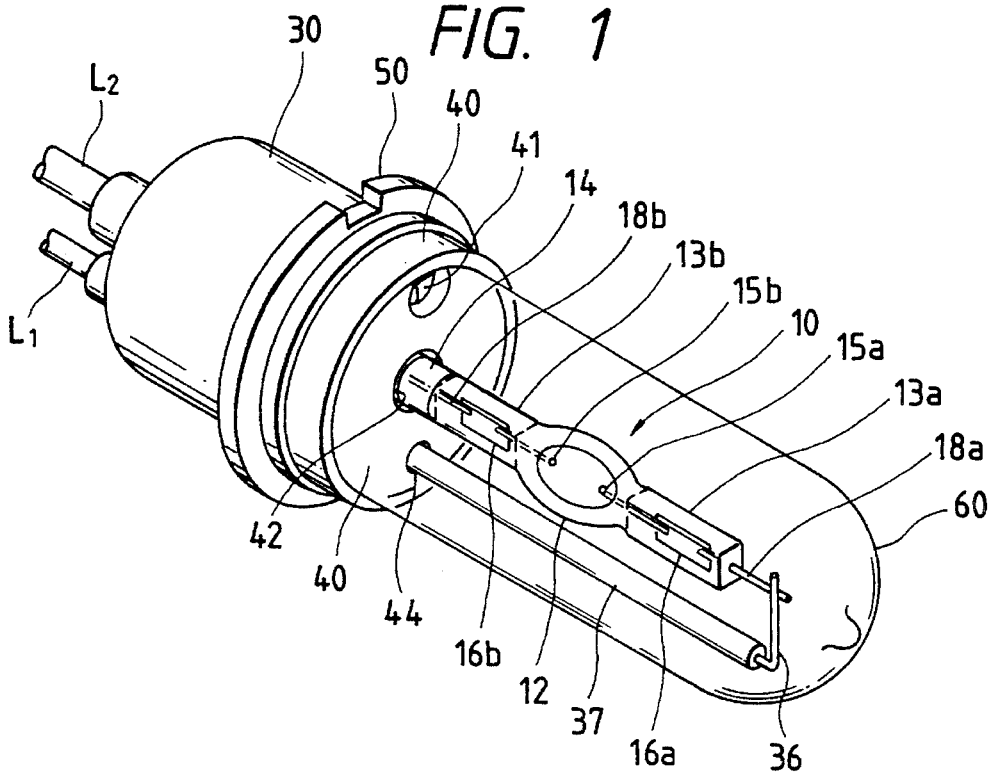
FIG. 1 is a perspective view of an embodiment of a discharge lamp device to which the present invention is applied.
Figure 2:
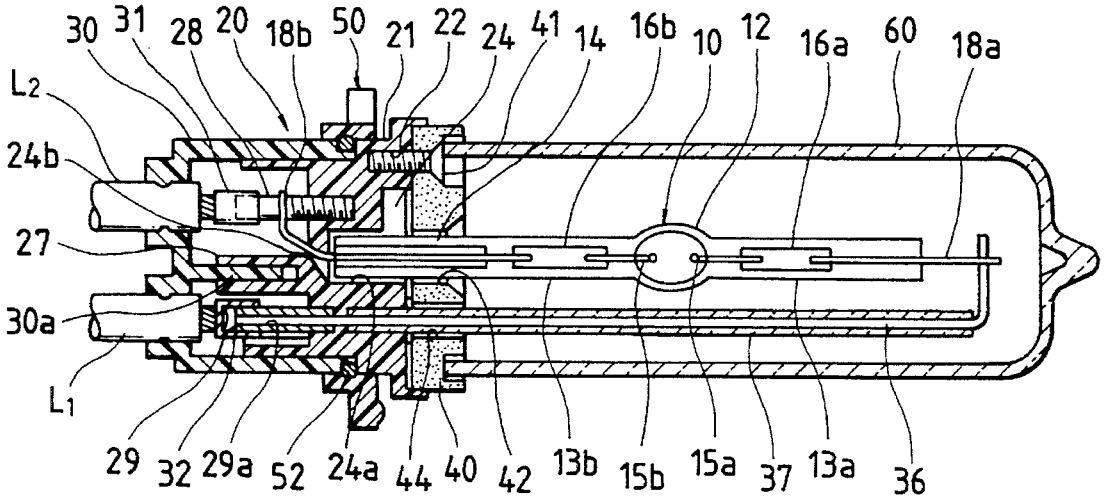
FIG. 2 is a longitudinal section view of the above discharge lamp device.
Figure 3:
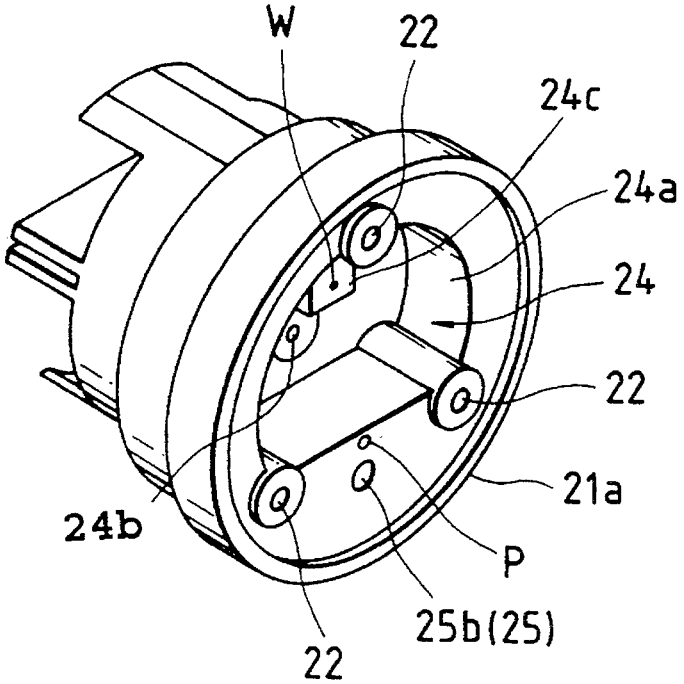
FIG. 3 is a perspective view of an insulating base used in the above discharge lamp device.
Figure 4:
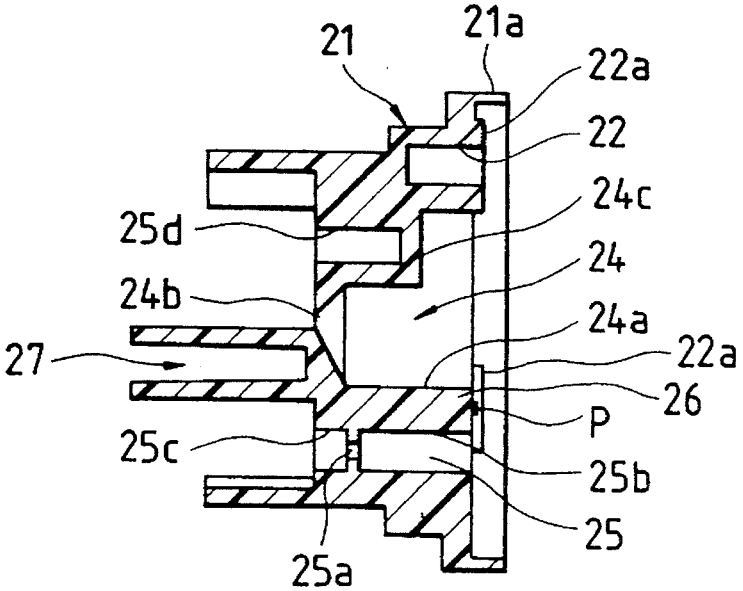
FIG. 4 is a longitudinal section view of the above insulating base.
Figure 5:
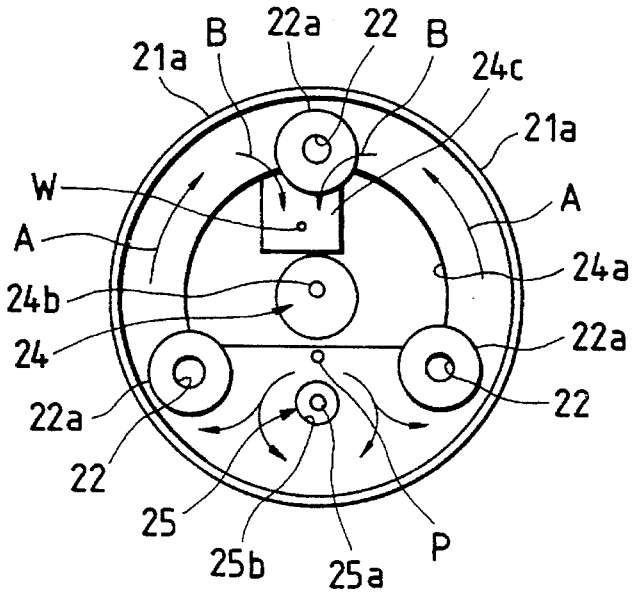
FIG. 5 is a front view of the above insulating base.
Figure 6:
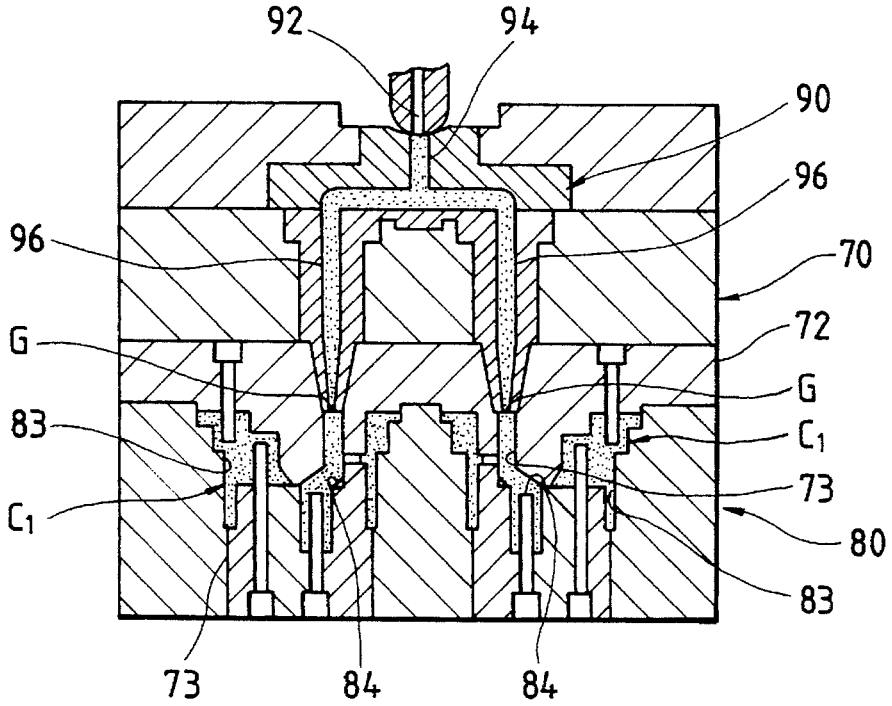
FIG. 6 is a section view of a metal mold for molding the above insulating base.
Figure 7:
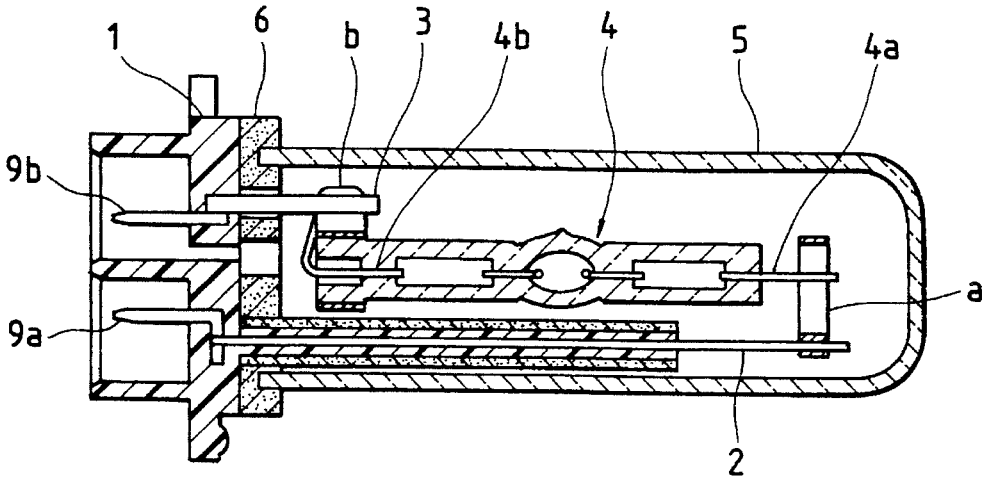
FIG. 7 PRIOR ART
FIG. 7 is a longitudinal sectional view of a conventional discharge lamp device.

In FIGS. 1 to 6 there is shown a first embodiment of an insulating base for a discharge lamp device according to the invention. In particular, FIG. 1 is a perspective view of a discharge lamp device to which the present invention is applied, FIG. 2 is a longitudinal section view of the discharge lamp device, FIG. 3 is a perspective view of an insulating base used in the discharge lamp device, FIG. 4 is a longitudinal section view of the insulating base, FIG. 5 is a front view of the insulating base, and FIG. 6 is a sectional view of a metal mold used for molding the insulating base.

In these figures, the discharge lamp device is composed mainly of an arc tube 10 serving as a light source, an arc tube holder 20 for supporting the arc tube 10, and an ultraviolet-ray screening globe 60 enclosing the arc tube 10.

The arc tube 10 includes a generally cylindrically shaped quartz glass tube with the portion thereof at its ends pinch-sealed, an ellipsoid-shaped sealed glass globe 12 for defining a discharge space, and pinch seal portions 13*a* and 13*b*, each having a rectangular transverse section and disposed at the two end portions of the sealed glass globe 12. A rare gas for starting purposes, mercury and metal iodide, are sealed into the sealed glass globe 12. Within the discharge space, discharge electrodes 15*a* and 15*b*, each formed of tungsten, are disposed at mutually opposing positions. The discharge electrodes 15*a* and 15*b* are connected to respective molybdenum foils 16*a* and 16*b* sealed in the pinch seal portions 13*a* and 13*b*, respectively. From the pinch seal portions 13*a* and 13*b* there are arranged leads 18*a* and 18*b*, which are connected to the molybdenum foils 16*a* and 16*b* respectively. The front-side lead 18*a* is spot welded to the front end portion of a lead support 36. On the other hand, the rear-side lead 18*b* is inserted through a cylindrical extension portion 14, which is formed continuously with the pinch seal portion 13*b* but is not pinch sealed, extends outwardly, and is welded to a terminal 28 provided in the arc tube holder 20.

The arc tube holder 20 includes a disk-shaped insulating base main body 21 (which is hereinafter referred to simply as a base) formed of synthetic resin and having at the rear portion thereof a pair of terminals 28 and 29 serving as a power supply cord connecting portion 27, a ceramic disk 40 fixed integrally to the front surface of the base 21 for supporting the rear end portion of the arc tube 10 and the rear end opening portion of an ultraviolet-ray screening globe 50, and a metal lead support 36 extending forwardly through the base 21 and disk 40 for supporting the front end portion of the arc tube 10.

The insulating base 21 includes a peripheral wall 21*a* in the peripheral edge portion of the front surface thereof. The ceramic disk 40, which is in engagement with the inside portion of the peripheral wall 21*a*; is fixed thereto by a screw 41. The screw 41 is formed of brass to prevent the screw from generating heat when exposed to high frequency electromagnetic radiation when a focusing ring 50 is welded integrally to the base 21 by means of high frequency induction heating. Reference numeral 22 designates a screw hole into which the screw 41 is inserted. The disk 40 includes a circular hole 42 in the central portion thereof. The rear end portion of the arc tube 10 extends through the circular hole 42 and is engaged with an arc tube engaging recess 24*a* formed in the insulating base 21. In the bottom portion of the engaging recess 24*a* there is formed a small hole 24*b* which extends to the rear surface of the base. The engaging recess 24*a* and small hole 24*b* form an insertion hole 24 for the arc tube rear-side lead. An inorganic adhesive agent is filled in the circular hole 42 in the disk 30, and the rear portion of the arc tube 10 is fixed to and supported by the circular hole 42 formed in the disk 40.

Further, the base 21, as shown in FIG. 4, includes a lead support through hole 25*a*. A lead support 36 is inserted through the through hole 25*a* and extends forwardly of the base 21. Reference numeral 37 indicates a ceramic insulating tubular member fitted over the lead support 36 for preventing electrical discharge. The rear end portion of the insulating tubular member 37 is fixed by an inorganic adhesive agent filled into a through hole 44 formed in the ceramic disk 40. An insertion hole 25*b* for insertion of the insulating tubular member 37 and an insertion hole 25*c* for threadedly engaging the terminal 29 are formed continuously with the lead support through hole 25*a*. The three holes 25*a*, 25*b* and 25*c* form a lead support insertion hole 25.

The engaging recess 24*a* formed in the front surface of the base 21 for engagement with the rear end portion of the arc tube rear has a semicylindrical shape considerably greater in size than an arc tube rear end extension portion 14. An adiabatic air layer is formed between the arc tube rear end extension portion 14 and the inner wall of the engaging recess 24*a*. Further, the peripheral edge portion 22*a* of the screw hole 22 formed in the front surface of the base 21 projects slightly forward to thereby decrease the contact area between the synthetic resin base 21 and the ceramic disk 40. Due to this, heat flow from the side of the arc tube 10 to the side of the insulating base 21 is impeded, which reduces the possibility of the base 21 being deteriorated by heating.

In the present embodiment, the screw hole peripheral edge portion 22*a* projects slightly to thereby hold the disk 40 in a state slightly floating from the front surface of the base 21, while the screw hole peripheral edge portion 22*a* is also used to position the disk 40 on the front surface of the base 21 properly. That is, although, as will be described later, a gate trace P formed during the molding of the base 21 is left in a raised state on the front surface of the base 21, by controlling the mounting position of the bottom surface of the disk 40 by use of the screw hole peripheral edge portion 22*a*, the disk 40 can be properly mounted on the front surface of the base 21 without being influenced by the raised gate trace P.

A pair of terminal insertion holes 25*c* and 25*d* (see FIG. 4) are formed in the rear end portion of the base 21, and terminals 28 and 29 threadedly inserted through the terminal insertion holes 25*c* and 25*d*, respectively, project rearward of the base 21 rear end portion. A lead 18*b*, which extends from the small hole 24*b* forming the lead insertion hole 24 toward the rear side of the base, is welded to the terminal 28 projecting rearward of the rear portion of the base 21. On the other hand, the rear portion of the lead support 36 extending through the base 21 is inserted into and welded to a lead support insertion hole 29*a* for the other terminal 29, which also projects rearward of the rear portion of the base 21. A dual separation wall 27 extends from the base 21 to a substantially central position between the terminals 28 and 29, and is engaged with an extension portion 30*a* formed in a plug cover 30, thereby providing a high degree of insulation between the terminals 28 and 29.

The plug cover 30 with the two power supply cords $L_1$ and $L_2$ inserted therethrough is engaged with and inserted into the rear portion of the base 21, and cap-type connectors 31 and 32, respectively provided on the power supply cords $L_1$ and $L_2$, are mounted on the terminals 28 and 29, respectively. Reference numeral 50 designates a focusing ring which is disposed over the peripheral portions of a ring member 52 formed of metal. The focusing ring 50 is mounted integrally with the base 21 due to the fact that the ring member 52 is high-frequency induction heated.

An ultraviolet-ray screening globe 60 enclosing the arc tube 10 is arranged such that an ultraviolet-ray screening film formed of a material such as ZnO or the like and capable of cutting off ultraviolet rays is coated on the outside and/or inside of a glass globe, thereby cutting off ultraviolet rays of wavelengths harmful to health and to protect adjacent components from deterioration due to light generated by the discharge portion of the arc tube 10. The ultraviolet-ray screening globe 60 includes a closed spherical front end portion and an open rear end portion which is in engagement with the front surface of the disk 40. An inorganic adhesive agent is filled in the engaging portion between the globe 60 and disk 40 to thereby provide a structure in which the interior of the globe 60, that is, the periphery of the arc tube 10, is isolated from the exterior of the globe 60. This prevents low molecular siloxane, which is generated in the lamp chamber space where the discharge lamp device is disposed, from entering the interior of the globe 60, thereby eliminating the possibility that $SiO_2$ will adhere to the surface of the arc tube 10 when the arc tube is heated to a high temperature.

Figure 8:
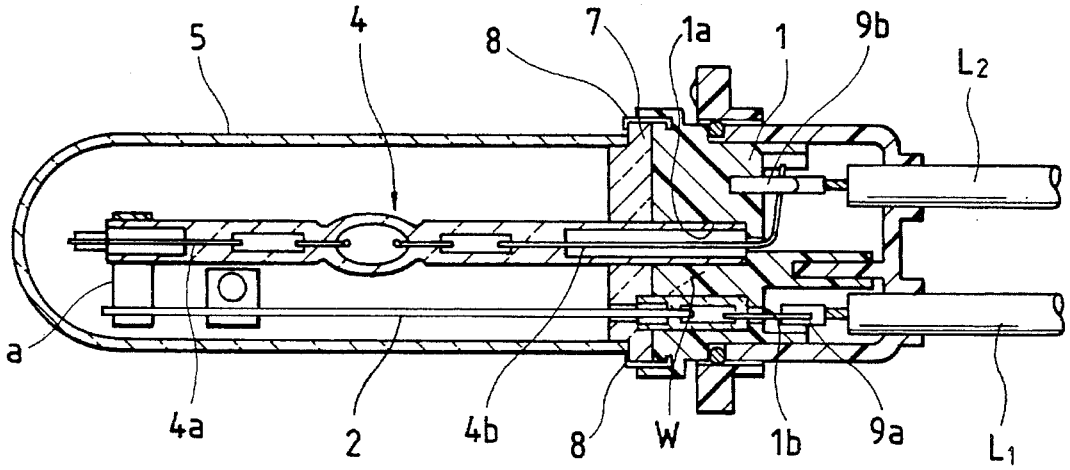
FIG. 8 PRIOR ART
FIG. 8 is a longitudinal sectional view of the conventional discharge lamp device.
Figure 9:
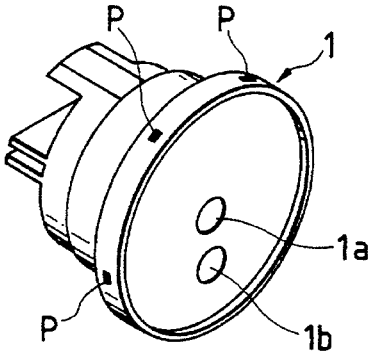
FIG. 9 PRIOR ART
FIG. 9 is a perspective view of an insulating base used in the conventional discharge lamp device.
Figure 10:
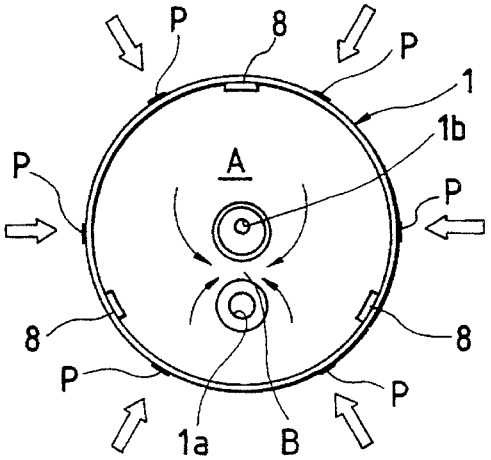
FIG. 10 PRIOR ART
FIG. 10 is a front view of the insulating base used in the conventional discharge lamp device.
Figure 11:
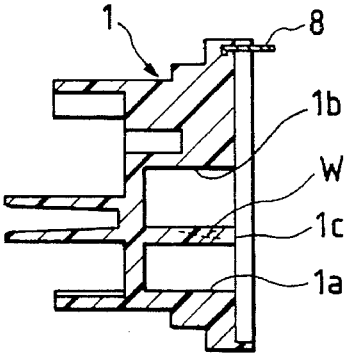
FIG. 11 PRIOR ART
FIG. 11 is a longitudinal section view of the conventional insulating base.

Within the arc tube engaging recess 24*a* formed in the front surface of the base 21, as shown in FIGS. 4 and 5, there is provided a forwardly projecting portion 24*c* which is used to form a threaded terminal mounting hole 25*d* on the rear surface of the base 21, so that the thickness of the overall base 21 is substantially uniform. In other words, if the base 21 includes thick and thin portions which differ significantly in thickness from each other, then the flow of the molten resin during the base molding operation can be retarded in the thin portion (the to narrow portion within the cavity), and thus a weld portion W (see FIGS. 8, 10 and 11 in which the prior art is shown) can be produced in the thin portion. On the other hand, according to the present invention, by forming the large recess 24*a* on the front surface side of the base 21, the thickness of the base 21 can be made substantially uniform, which makes it difficult for the weld portion to be produced in the base 21.

The base 21 is molded in such a manner that the gates used for molding the base 21 are situated on the upper end surface of a relatively thin separation wall 26 which separates the lead support insertion hole 25 from the engaging recess 24*a*. Accordingly, since the molten resin is supplied first to a portion corresponding to the thin separation wall 26, there is no possibility that the weld can be produced in the thin separation wall 26.

Arrows in FIG. 5 show directions in which the molten resin flows within the cavity. In particular, the molten resin flows to the right and left along the surface of the engaging recess 24*a* (in the direction of an arrow A), and the right and left flows of the molten resin, as shown by arrows B, collide with each other at the position of a projection 24*c* and are then superimposed on each other. Therefore, if the weld portion W were to be produced, it would be produced at the position of the projection 24*c*. However, since the weld portion W is disposed on the side of the lead insertion hole 24 opposite the lead support insertion hole 25, the path through the weld portion W between the lead 18*b* inserted into the base 21 and the lead support 36, which runs around the engaging recess 24*a*, is quite long, thereby eliminating the possibility that the insulation durability of the base 21 will be deteriorated.

In FIG. 6, there is shown a sectional view of a molding device which is used to injection mold the base 21. The molding device includes an upper metal mold 70 disposed on the fixed side of the molding device and a lower metal mold 80 disposed on the movable side thereof. A core part 72 with a molding surface 73 for molding the front surface side of the base 21 is provided integrally with the upper metal mold 70. On the other hand, the lower metal mold 80 includes molding surfaces 83 and 84 which are used to mold the rear side of the base 21. The upper and lower metal molds 70 and 80 mesh with each other in a vertical direction, and the molding surfaces 73, 83 and 84 cooperate in forming a cavity $C_1$.

There are formed a pair of cavities $C_1$ in such a manner that the mold faces upwardly. The upper end portion of the separation wall 26 between the lead support insertion hole 25 and the lead insertion hole 24 (engaging recess 24*a*) formed in the base faces gates G, which are molten resin injection holes formed in a hot runner mechanism 90. The hot runner mechanism 90 is composed mainly of a sprue portion 94 extending vertically from a resin supply port 92, and hot runner portions 96 diverging right and left from the sprue portion 94 and extending downwardly. In the hot runners 96, the molten resin is maintained at a proper temperature by a heating device (not shown), and thus the molten resin can be injected from the gates G into the cavities $C_1$ in a sufficiently molten state. The base molded by the molding device shown in FIG. 6 is shown in FIGS. 3 to 5. Reference character P used in these figures designates gate traces. Because the gate traces P are situated on the front surface of the base 1, which is hidden by the disk 40, they are not exposed to the outside at all, thus providing a good appearance. In these drawings, W indicates a weld portion.

As can be clearly understood from the foregoing description, according to the insulating base for a discharge lamp device of the invention, no weld is produced in an area between the arc tube rear side lead insertion hole and the lead support insertion hole, and, in case any weld portion is produced, it will be produced on the opposite side of the lead insertion hole from the lead support insertion hole, which area is free from the problem of insulation durability. Therefore, according to the invention, there is obtained a good insulation effect between the arc tube rear side lead inserted into the base and the lead support.

Also, because the gate traces left in the base are situated in the portion of the base front surface which is not exposed to the outside, the base has a good appearance as well.

What is claimed is:

1. An insulating base for a discharge lamp device comprising a generally disk-shaped base main body molded of synthetic resin having formed therein a lead support insertion hole for mounting a lead support for supporting a front end portion of an arc tube and providing a current path to a lead on a front end of said arc tube, and a lead insertion hole formed in a front surface of said base main body for insertion of a lead disposed on a rear side of said arc tube, the improvement wherein a separation wall is formed in said base main body between said lead support insertion hole and said lead insertion hole, and wherein at least one gate mark is disposed on a face of said separation wall as a result of a molding operation in which at least one resin injection gate opposes said face so that there are no gate marks on the outer periphery of said base main body.

2. The insulating base for a discharge lamp device of claim 1, wherein said lead support insertion hole and said lead insertion hole are each a longitudinal through hole.

3. The insulating base for a discharge lamp device of claim 1, wherein a rear surface of said base main body has a threaded terminal mounting hole for receiving a terminal.

4. The insulating base for a discharge lamp device of claim 1, wherein said lead insertion hole is semicylindrical in shape.

5. The insulating base for a discharge lamp device of claim 1, wherein an upper end portion of the insulating base faces said molten resin injection gate.

6. The insulating base for a discharge lamp device of claim 1, further comprising a ceramic disk fixed integrally to and covering an upper surface of the insulating base.

* * * * *